United States Patent [19]

Warncke et al.

[11] 4,289,238

[45] Sep. 15, 1981

[54] READINESS RECEPTACLE FOR RESPIRATORS

[75] Inventors: Ernst Warncke, Lübeck; Joachim Schlobohm, Oldesloe; Jürgen Behnke, Lübeck, all of Fed. Rep. of Germany

[73] Assignee: Drägerwerk Aktiengesellschaft, Fed. Rep. of Germany

[21] Appl. No.: 81,936

[22] Filed: Oct. 4, 1979

[30] Foreign Application Priority Data

Oct. 6, 1978 [DE] Fed. Rep. of Germany ..... 2843652

[51] Int. Cl.[3] ..... B65D 3/26; B65D 77/30

[52] U.S. Cl. ..... 206/527; 206/616; 206/619; 312/211; 312/245; 220/18

[58] Field of Search ..... 206/438, 527, 616, 619; 221/25; 312/211, 245; 9/11 A; 232/1 D; 220/403, 460, 18, 413

[56] References Cited

U.S. PATENT DOCUMENTS

| | | | |
|---|---|---|---|
| 1,732,452 | 10/1929 | Wells | 232/1 D |
| 1,985,615 | 12/1934 | Mitchell | 206/527 |
| 2,095,974 | 10/1937 | Finch | 9/11 A |
| 2,754,991 | 7/1956 | Hagerty | 220/18 |
| 3,266,655 | 8/1966 | Trunk | 220/18 |
| 3,828,856 | 8/1974 | Wallis | 206/527 |
| 3,958,749 | 5/1976 | Goodrich | 206/619 |
| 4,018,242 | 4/1977 | Schlegel | 220/18 |

FOREIGN PATENT DOCUMENTS

| | | | |
|---|---|---|---|
| 304513 | 1/1929 | United Kingdom | 232/1 D |

*Primary Examiner*—Herbert F. Ross
*Attorney, Agent, or Firm*—McGlew and Tuttle

[57] ABSTRACT

A readiness receptacle for housing a device such as a respirator, includes a first shell portion hingedly connected to a second shell portion. The connected shell portions define a space in which the device is disposed in a tearable bag sealed on all sides. At least one of the shell sections is pivotable to open said receptacle. A tear strap is connected to the tearable bag and portions of the tear strap are connected to each of the shell portions for tearing open the tearable bag simultaneously with the opening of the shell portions.

13 Claims, 12 Drawing Figures

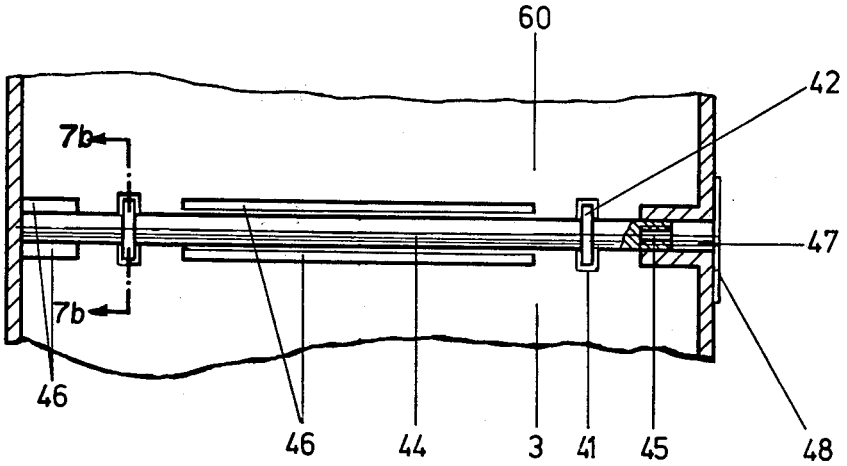
FIG. 7a
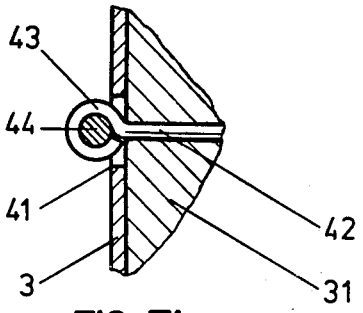
FIG. 7b
FIG. 8a
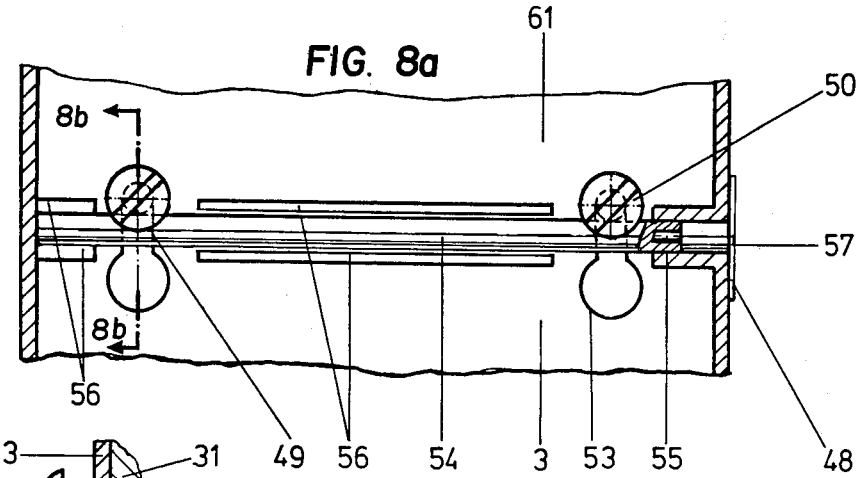
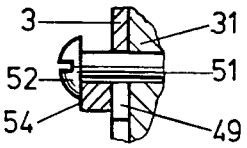
FIG. 8b

READINESS RECEPTACLE FOR RESPIRATORS

FIELD AND BACKGROUND OF THE INVENTION

This invention relates to the construction of receptacles in general and, in particular, to a new and useful readiness receptacle for housing a device such as a respirator contained in a sealed enclosure which includes two partly separable shells operatively connected to the enclosure which, upon opening, simultaneously open the sealed enclosure.

A readiness receptacle contains a respirator which can be used as escape equipment. It could be continuously available for such a purpose, for example, hooked or otherwise secured to the wall of a hotel room. The design of the readiness receptacle must be such that, as is absolutely necessary in catastrophies, the respirator can be taken out without difficulty by untutored persons without practice and even in the dark.

A readiness receptacle for respirators is known which consists of two or more shells which are held together by a tensioning closure disposed on a wire or by a tape or the like surrounding the receptacle. The closure may be formed by a yoke fastened to one tape end and by a hook type end of the other tape end. Water-sensitive respirators are typically disposed in the receptacle packed in an envelope impermeable to water and steam, for example, consisting of paraffined paper, plastic or rubber.

In one known embodiment, the respirator is accommodated in a tearable bag closed on all sides. The tearable bag is arranged in a receptacle formed of two shells in such a way that the bag is torn open as the receptacle is opened. For this purpose, ribbons are provided on the bag which is fastened, e.g., with perforations on the eyes disposed on the receptacle. This type of known respirator is carried on the body of the wearer. For emergency use, the receptacle can, after the tape closure has been opened, be opened by pulling the shells apart, whereby, the bag is torn open simultaneously, thus, releasing the respirator. Both hands must be used for opening. Because of the stresses occurring in carrying, the receptacle is made of a sturdy material. Notwithstanding the facts of user familiarity with the manipulations and the standard carrying of the equipment, in darkness, the opening manipulations nevertheless present special difficulties (See German Patent Specification No. 10 02 203).

SUMMARY OF THE INVENTION

An object of the invention is to provide a simple readiness receptacle which can be reliably opened without practice in an emergency situation and which, if suspended from a wall, can be operated with one hand.

In accordance with an object of the invention, a readiness receptacle for housing a device such as a respirator includes a first shell portion hingedly connected to a second shell portion. The connected shell portions define a space in which the device is disposed within a tearable bag which may, for example, be made from a steam-impermeable material closed on all sides. At least one of the shell sections is pivotable to open the receptacle. A tear strap connected to the tearable bag has a portion connected to each of the shell portions for tearing open the tearable bag. Wall attachment means on one of the shell portions is provided for mounting the receptacle on a wall structure and a handle on the other of the shell portions is engageable to pivot at least one of the shell portions to simultaneously open the receptacle and tear open the tearable bag. A latch member is provided for latching the sections together.

In accordance with a preferred embodiment of the invention, a receptacle for housing a device, such as a respirator within a tearable bag connected to the receptacle for simultaneous opening therewith includes a first shell section and a second shell section hingedly connected. Each of the shell sections has a side wall and top, bottom and side edge portions extending laterally of the side wall. The edge portions of the first shell section are matingly fitted to corresponding edge portions of the second shell section wherein a mutually facing portion of each shell section defines a concavity and said concavities together define a receptacle containing area. Hinge means connect an edge portion of the first shell section to a corresponding edge portion of the second shell section. An elongated latch member connected to the first shell section adjacent another of the edge portions extends through the containing area and is detachably connected to the second shell section. A tear strap is provided having a portion connecting the tearable bag within the containing area of the receptacle. A first engaging member, characterized as a pushbutton, engages a portion of the tear strap and connects it to the first shell section and a second engaging member engages a portion of the tear strap and connects it to the second shell section. An attachment member is provided having attachment means formed integrally of the second shell section for fixedly mounting the receptacle to a wall structure.

It is an advantage of the invention, in particular, that untutored persons, for example, hotel guests may remove the respirator from a readiness receptacle hainging on a wall without difficulty. Even in darkness and with the additional factor of nervousness in an emergency situation, the endangered person can open the inventive readiness receptacle with one hand simply by pulling on a grip plate. After the front shell has been flapped down, the respirator to be taken out with the other hand lies open before him.

In accordance with a feature of the invention, attachment of the closed readiness receptacle and, thus, of the respirator, on the wall is by wall attachments. The type and function of the wall attachments is, because of their obscured or covered arrangement, not perceptible to unauthorized persons. Hence, inadvertent or unauthorized placement of the readiness receptacle at a different location is prevented in a simple manner. In an emergency situation, therefore, it is always available at the known place. Removal for inspection purposes is easily performed in accordance with another advantage of the inventive construction. The latch closure prevents reclosing of the readiness receptacle. It thus becomes impossible in an advantageously simple manner that in a closed readiness receptacle, there can be a defective respirator after unauthorized opening.

By taking out the pushbuttons from the rear, readiness inspections are simple. After removal of the pushbuttons, the tear strap is detached; thus, the tear bag is not torn open any more upon flapping down of the front shell.

A further object of the invention is to provide a readiness receptacle for housing a device such as a respirator which is simple in design, rugged in construction and economical to manufacture.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which preferred embodiments of the invention are illustrated.

BRIEF DESCRIPTION OF THE DRAWINGS

In the Drawings:

FIG. 7*a* is a front view, partly in section, of still another arrangement for attaching a readiness receptacle to a wall in accordance with the invention;

FIG. 7*b* is a side section of the arrangement of FIG. 7*a* taken along the lines 7*b*—7*b;*

FIG. 8*a* is a front view, partly in section, of a still further arrangement for attaching a readiness receptacle to a wall in accordance with the invention; and FIG. 8*b* is a side section of the arrangement of FIG. 8*a* taken along the lines 8*b*—8*b.*

DETAILED DESCRIPTION OF THE PREFERRED EMBODIMENTS

Figure 1:
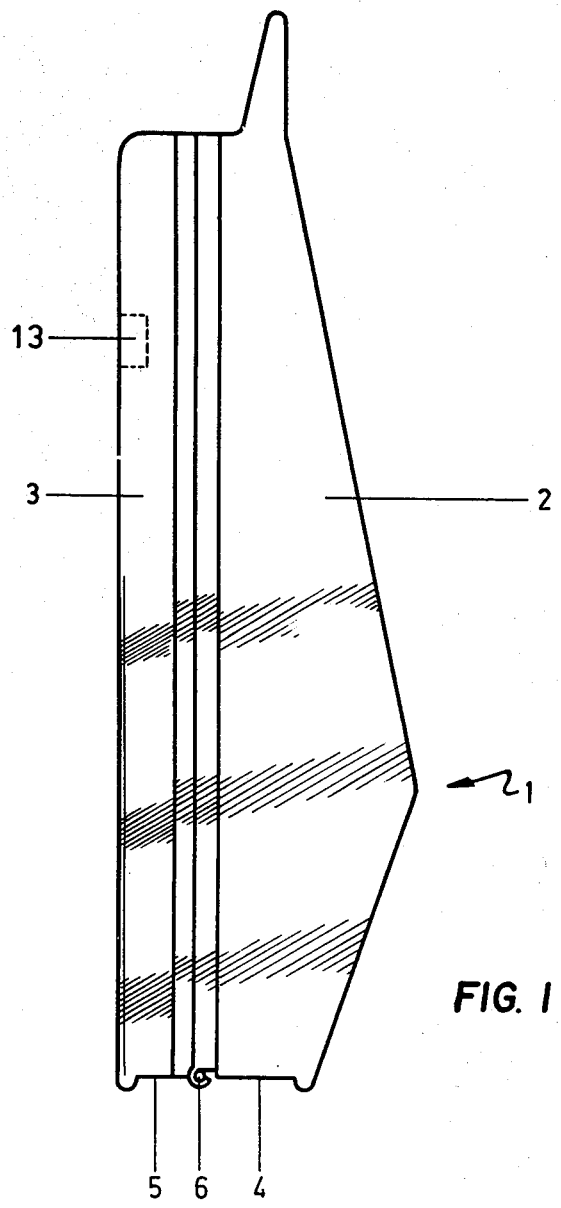
FIG. 1 shows the side view of the readiness receptacle according to the invention.

Referring now to the drawings in particular, the invention embodied therein, comprises, a readiness container or receptacle 1 which, in the embodiment illustrated in FIG. 1, is shown in a closed, vertical position. The receptacle 1 has a front shell section 2 and a back shell section 3 matingly meshed. Each shell section includes a side wall and top, bottom and side edge portions extending laterally of the side wall forming at least part of the receptacle containing area adjacent one side of said shell sections. Each of the edge portions of shell section 2 mates with a corresponding edge of shell section 3 in the closed position. The front shell section 2 and the back shell section 3 are joined, respectively, at the bottom edge portions 4 and 5, by a hinge 6.

A latch closure arrangement 7 is provided within receptacle 1 at its upper end. The latch closure arrangement 7 includes an elongated, elastic latch member 8 attached to the front shell section 2 extending through an aperture 70 formed through the side wall of the rear shell section 3. Latch member 8 includes a recess surface intermediate the ends thereof and a pawl formed on one end of the latch member. A convex abutment depending from at least one part of the upper edge of the rear shell section extends into the recess of the recess surface and includes a generally concave abutment 9 formed in the outer surface of the side wall of the rear shell section 3 for seating the pawl 12 when receptacle 1 is closed.

A hand grip plate 11 is attached to the top of shell section 2. Upon opening the receptacle 1, by pulling on the grip plate 11, the pawl 12 slips out of the concave abutment 9; the front shell 2 can then be swung down. For safe gripping on opening, the grip plate 11 has a raised edge 29 (thickening) extending backward counter to the direction of opening. The grip plate is preferably made of a luminous material.

The readiness receptacle 1 is suspended at the back shell 3 by means of an attachment 13. The attachment described hereafter is effected with the readiness receptacle 1 closed. This prevents unauthorized removal from the wall and assures retention of the respirator at a location which must first be chosen. The latch closure 7 can be closed again only by means of a tooling device (not shown). Without this device, the latch 8 would be caught with its pawl 12 hanging in the convex abutment 10 as the shells are flapped together. With this design, any unauthorized opening of the readiness receptacle 1 is readily noticeable upon inspection.

Figure 4A:
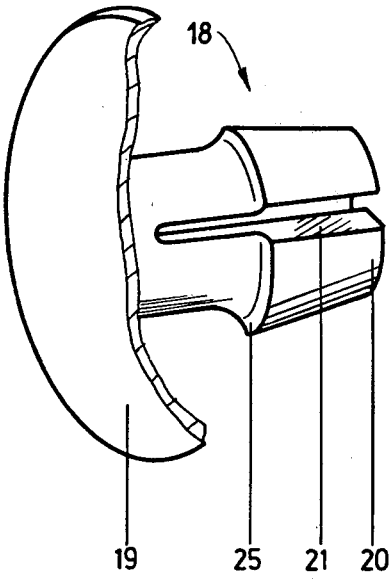
FIG. 4*a* is a perspective view, partly broken away, of a pushbutton for receiving a tearable bag tear strap in accordance with the invention.
Figure 4B:
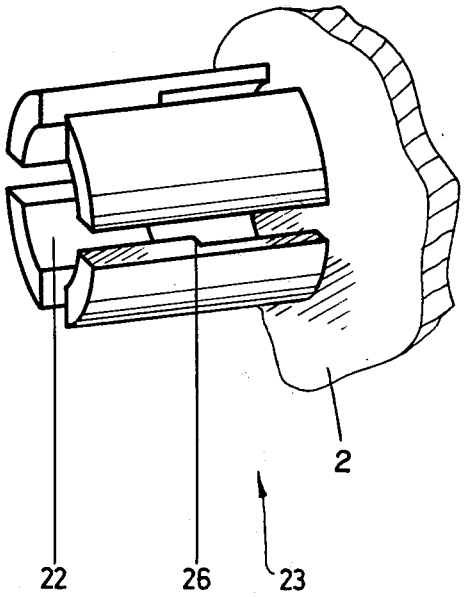
FIG. 4*b* is a perspective view of a mounting member for receiving a pushbutton of the type shown in FIG. 4*a;*

A respirator 14, packed in a tearable, steam-permeable bag 15, sealed on all sides, is housed in the receptacle. The bag 15 is connected by a first tear strap 16 to the back shell 3 and by a second tear strap 17 to the front shell 2. The connection is effected through two pushbuttons 18. As is best shown in FIG. 4*a*, pushbutton 18 consists of a head 19 connected to a shank 20 provided with at least one longitudinal slot 21 and includes an outer circular detent 25. It is possible to introduce the pushbutton into a hole 22 of a mount 23, such as is shown in FIG. 4*b*, or into a hole 24 formed in the shells.

Figure 2:
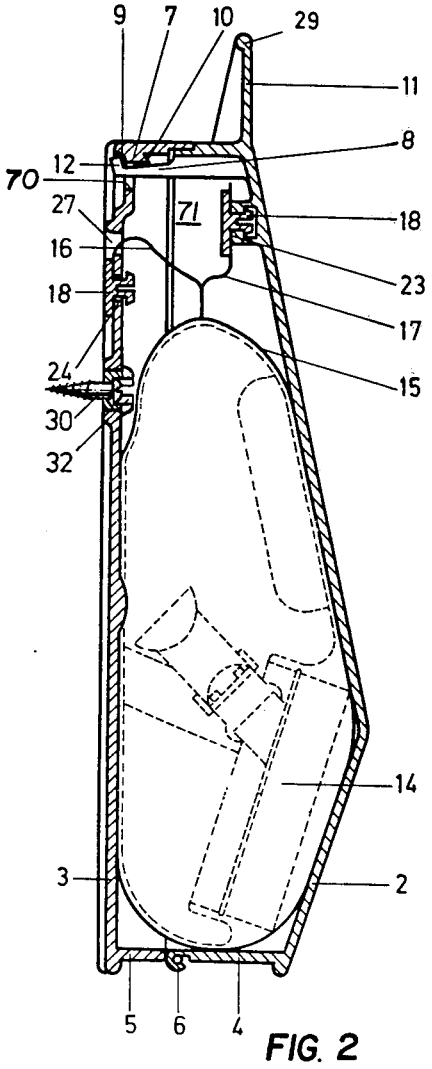
FIG. 2 illustrates a longitudinal side section of a readiness receptacle containing a respirator.

After introduction, the detent 25 engages in mount 23 of the front shell 2 behind a constriction 26, in the case of the back shell 3, as shown in FIG. 2, after introduction into hole 24 behind the inner side of the shell wall.

Two pushbuttons 18 which consist of the tear strap 16 with the back shell 3 are introduced from the outside. The back wall is provided with an opening 27 passing the tear strap 16 out. This design, as described hereinbelow, facilitates removal of the respirator 14 from the readiness receptacle 1 for inspection purposes. With the tear strap 16 released, the respirator 14, follows without tearing stress for the bag 15, as the front shell 2 is being swung down.

Figure 3:
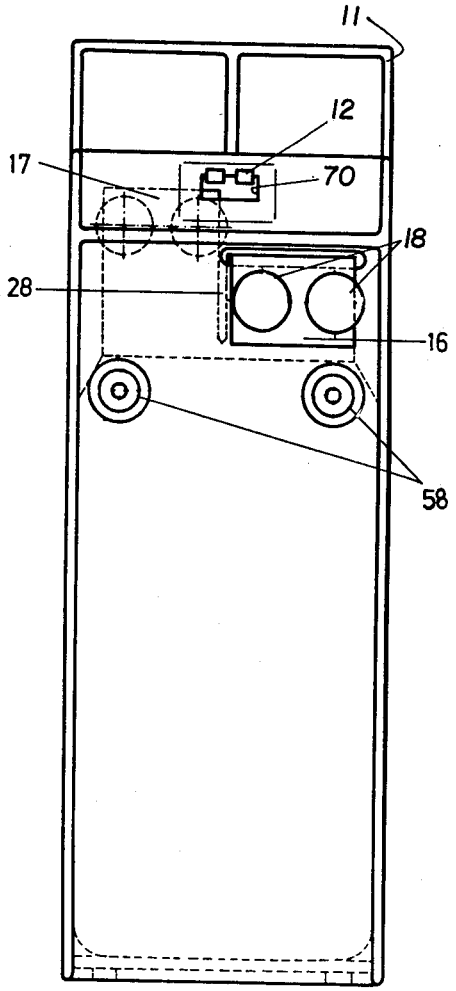
FIG. 3 is a rear view of the receptacle of FIG. 2.

A defined tearing of bag 15 on opening the readiness receptacle 1 is ensured by a tear incision 28, shown in FIG. 3, between straps 16 and 17. The bag may be formed of a material including a barrier layer foil of aluminum foil coated on both sides with polyethylene. Details of different wall attachments are illustrated in FIGS. 5, 6, 7 and 8.

Figure 5A:
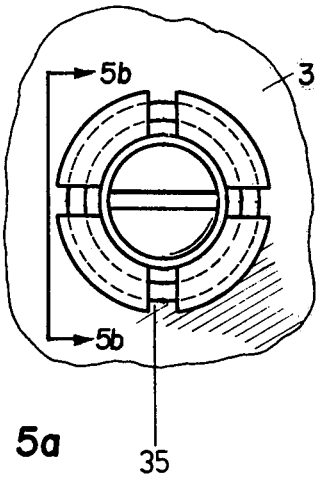
FIG. 5*a* is a front view of an arrangement for attaching a readiness receptacle to a wall in accordance with the invention.
Figure 5B:
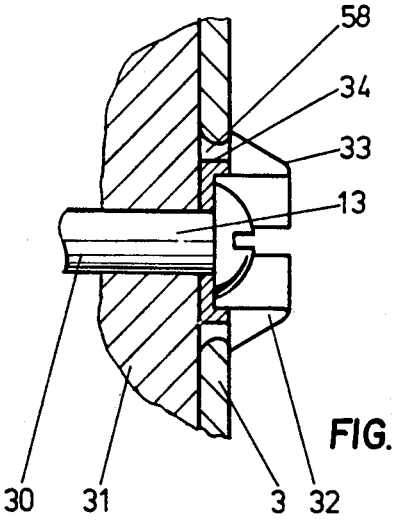
FIG. 5*b* is a side section of the arrangement of FIG. 5*a* taken along the lines 5*b*—5*b;*
Figure 6:
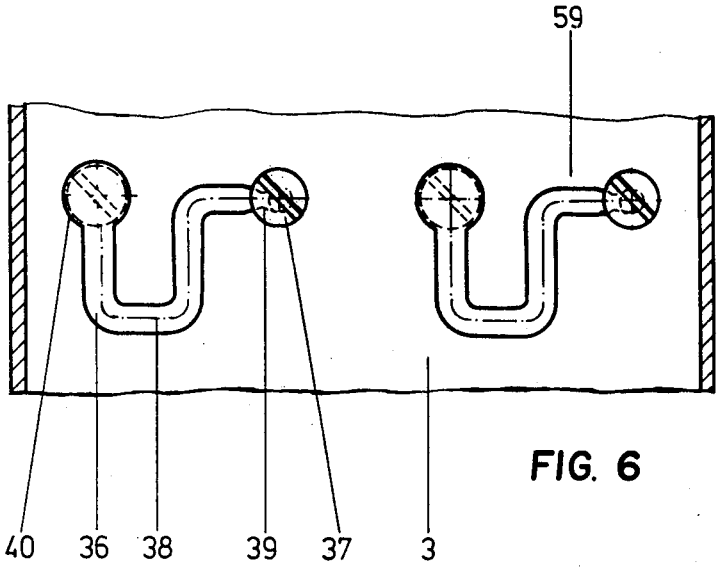
FIG. 6 is a front view of another arrangement for attaching a readiness receptacle to a wall in accordance with the invention.

In the embodiment of wall attachment according to FIGS. 5*a* and 5*b*, the back wall of the back shell 3 is provided with one or more holes 58. Safety knobs 32 are secured to the wall 31 by screws 30. The safety knobs 32 consist of an externally conical rim 33 provided with four slots 35. The base of the rim 33 has a diameter which is slightly greater than the hole 58. The safety knob has a shank 34 connected to the rim which corresponds in height and diameter to the hole 58. For better plugging of the holes 58 over the conical rims 33, the latter are squeezed together by the edges of the holes 58. When the edges of the holes 58 snap in behind the conical rims 33 around the shanks 34 in the manner (a) initially positioning a second destructable hollow auxiliary mold form (12) within the outer mold and in intimate contact therewith but subsequently spaced from and surrounding said first auxiliary mold form, and (b) simultaneously chemically dissolving said first and second auxiliary mold forms after said introducing and hardening steps.

3. A process according to claim 2, wherein the auxiliary moulds consist of a material which is resistant to heat and pressure and which is dissolved by an acid or an alkali.

4. A process according to claim 3, wherein the auxiliary moulds consist of plaster of Paris.

5. A process according to claim 4, wherein the casting material is glass, and it is introduced into the mould in a molten state.

6. A process according to claim 4, wherein the casting material is introduced into the mold in a comminuted state, and is heated in the mold until liquefied.

7. A process according to claim 4, wherein the casting material is introduced in the mouldable state into the interior of the first auxiliary mould and is expanded against the auxiliary moulds by the application of pressure, for example by centrifuging or by compressed air.

8. A process according to claim 7, wherein the outer wall and inner wall are produced successively, the outer wall being first produced and kept at an elevated temperature which allows the bonding of the webs produced as part of the subsequently moulded inner wall.

9. A process according to claim 2, wherein an inner mould core (16) is positioned within but spaced from the first auxiliary mold before the casting material is introduced.

10. A process according to claim 2, wherein the walls are produced from a pre-moulded hollow glass parison (22) and are moulded by blowing.

11. A process according to claim 2, wherein thin regions (25) of the outer wall are removed after manufacture by grinding.

12. A process according to claim 2, wherein prefabricated parts, for example of metal, are introduced into the mould and are bonded to the vessel walls.

13. A mold assembly for the production of a hollow vessel from a meltable casting material such as glass, said vessel having at least two walls spaced apart and joined together by a plurality of lateral webs, comprising:

(a) a rigid hollow outer mold (11), (b) a first destructable hollow auxiliary mold form (12) disposed within the outer mold and in intimate contact therewith throughout, and (c) a second destructable hollow auxiliary mold form (14) disposed within said first auxiliary mold form but spaced therefrom to define an outer wall chamber therebetween, (d) said second auxiliary mold form having a plurality of lateral passages extending therethrough.

14. A mold assembly as defined in claim 13, wherein portions of the second auxiliary mold form extend outwardly into engagement with the first auxiliary mold form to delimit the outer wall chamber.

15. A mold assembly according to claim 13, further comprising a removable inner mould core (16) disposed within and spaced from the second auxiliary mould form to define an inner wall chamber therebetween.

* * * * *